US010044121B2

(12) United States Patent
Shimizu

(10) Patent No.: US 10,044,121 B2
(45) Date of Patent: Aug. 7, 2018

(54) PRESS-FIT TERMINAL

(71) Applicant: YAZAKI CORPORATION, Tokyo (JP)

(72) Inventor: Isanori Shimizu, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/423,915

(22) Filed: Feb. 3, 2017

(65) Prior Publication Data

US 2017/0229798 A1 Aug. 10, 2017

(30) Foreign Application Priority Data

Feb. 10, 2016 (JP) ..... 2016-023296

(51) Int. Cl.

| | |
|---|---|
| ***H01R 4/18*** | (2006.01) |
| ***H01R 12/58*** | (2011.01) |
| ***H01R 13/405*** | (2006.01) |
| *H01R 43/20* | (2006.01) |

(52) U.S. Cl.

CPC ..... *H01R 12/585* (2013.01); *H01R 13/405* (2013.01); *H01R 43/205* (2013.01)

(58) Field of Classification Search

CPC ..... H01R 12/585; H01R 13/405
USPC ..... 439/869; 1/869
See application file for complete search history.

(56) References Cited

U.S. PATENT DOCUMENTS 4,968,263 A * 11/1990 Silbernagel ..... H01R 13/6315 439/246
5,374,204 A 12/1994 Foley et al.
5,452,512 A 9/1995 Foley et al.
5,989,075 A * 11/1999 Hsiao ..... H01R 13/41 439/444
7,037,146 B2 * 5/2006 Nakamura ..... H01R 13/41 439/751
7,048,595 B2 * 5/2006 Nakamura ..... H01R 12/585 439/75

(Continued)

FOREIGN PATENT DOCUMENTS

JP H07-192799 A 7/1995
JP 2005-197092 A 7/2005

(Continued)

OTHER PUBLICATIONS

Communication dated Mar. 20, 2018, from Japanese Patent Office in counterpart application No. 2016-023296.

*Primary Examiner* — Tulsidas C Patel
*Assistant Examiner* — Nader Alhawamdeh
(74) *Attorney, Agent, or Firm* — Sughrue Mion, PLLC

(57) ABSTRACT

A press-fit terminal includes a fixing part to be fixed to a fixing member, a terminal part formed by a single member extending from one side face of the fixing part continuously, a press-fit part formed by the single member continuously extending from the other side face opposed to the one side face of the fixing part, the press-fit part to be closely inserted into a through-hole of a substrate and a receiving surface arranged on the one side face of the fixing part to be allowed to abut on a jig. A center position of the terminal part and a center position of the press-fit part are arranged alternately with respect to a center position of the fixing part. The center position of the press-fit part and a center position of the receiving surface are arranged so as to coincide with each other.

10 Claims, 5 Drawing Sheets

(56) References Cited

U.S. PATENT DOCUMENTS

| | | | | |
|---|---|---|---|---|
| 7,458,148 | B2 * | 12/2008 | Matsumura | H01R 43/20 29/837 |
| 7,488,219 | B2 * | 2/2009 | Matsumura | H01R 12/585 439/733.1 |
| 7,494,344 | B2 * | 2/2009 | Galauner | A61M 11/041 439/67 |
| 8,579,638 | B2 * | 11/2013 | Schaarschmidt | H01R 12/585 439/82 |
| 9,172,166 | B2 * | 10/2015 | Kida | H01R 13/41 |
| 9,263,820 | B2 * | 2/2016 | Mattiuzzo | H01R 13/415 |
| 9,461,398 | B2 * | 10/2016 | Nakamura | H01R 12/585 |
| 9,515,407 | B2 * | 12/2016 | Ohyama | H01R 13/41 |
| 9,559,451 | B2 * | 1/2017 | Uchida | H01R 12/585 |
| 2005/0176267 | A1 | 8/2005 | Saitoh | |
| 2005/0221687 | A1 * | 10/2005 | Nakamura | H01R 12/585 439/751 |
| 2006/0178023 | A1 * | 8/2006 | Matsumura | H01R 43/20 439/76.1 |
| 2007/0270001 | A1 * | 11/2007 | Matsumura | H01R 12/585 439/82 |
| 2014/0179173 | A1 * | 6/2014 | Suzuki | H01R 13/42 439/751 |
| 2014/0199861 | A1 * | 7/2014 | Mattiuzzo | H01R 13/415 439/81 |
| 2015/0364847 | A1 * | 12/2015 | Yao | H01R 12/57 439/869 |

FOREIGN PATENT DOCUMENTS

| | | | |
|---|---|---|---|
| JP | 4302545 | B2 | 7/2009 |
| JP | 2015-90746 | A | 5/2015 |

* cited by examiner

PRESS-FIT TERMINAL

CROSS REFERENCE TO RELATED APPLICATION

The present application is based on, and claims priority from Japanese Patent Application No. 2016-023296, filed Feb. 10, 2016, the disclosure of which is hereby incorporated by reference herein in its entirety.

BACKGROUND

Technical Field

The present application relates to a press-fit terminal, and in particular, to a press-fit terminal having a press-fit part to be closely inserted into a through-hole formed in a substrate.

Related Art

There is known a press-fit terminal according to a conventional example including a flange part as a fixing part to be fixed to a casing as a fixing member, a lower body part as a terminal part formed by a single member extending from one side face of the flange continuously, an upper body part as a press-fit part formed by the single member continuously extending from the other side face opposed to the one side face of the fixing part, the press-fit part to be closely inserted into a through-hole of a substrate, and receiving surfaces arranged on the one side face of the flange part to be allowed to abut on a jig (see JP 2015-090746 A).

In the press-fit terminal according to the conventional example, a center position of the lower body part and a center position of the upper body part are arranged so as to coincide with a center position of the flange part in a width direction of the flange part. With this configuration, the jig is allowed to support the two receiving surfaces of the flange part so as not to produce any movement of the fixing part in relation to the fixing member. From this state, the upper body part is closely inserted (i.e. press-fitted) into the through-hole of the substrate.

SUMMARY

In the press-fit terminal according to the conventional example, a center position of the terminal part and a center position of the press-fit part are arranged so as to coincide with each other in the width direction of the flange part, so that the receiving surfaces of the fixing part for abutment on the jig are divided into two portions on both sides of the terminal part.

Further, in the press-fit terminal according to the conventional example, center positions of the two receiving surfaces are different from the center position of the press-fit part. For this reason, in order to allow the press-fit part to be closely inserted into the through-hole of the substrate, it is required for the two receiving surfaces to have large abutting areas for abutment on the jig, thereby causing the fixing part to be large-sized.

In a situation, an object of the present application is to provide a press-fit terminal capable of miniaturizing a fixing part.

There is provided a press-fit terminal according to an aspect of the present application including: a fixing part to be fixed to a fixing member; a terminal part formed by a single member extending from one side face of the fixing part continuously; a press-fit part formed by the single member continuously extending from the other side face opposed to the one side face of the fixing part, the press-fit part to be closely inserted into a through-hole of a substrate; and a receiving surface arranged on the one side face of the fixing part to be allowed to abut on a jig. In the press-fit terminal, a center position of the terminal part and a center position of the press-fit part are arranged alternately with respect to a center position of the fixing part. Additionally, the center position of the press-fit part and a center position of the receiving surface are arranged so as to coincide with each other in a width direction of the fixing part.

In the press-fit terminal according to the aspect of the present application, the center position of the terminal part and the center position of the press-fit part are arranged alternately with respect to the center position of the fixing part. Therefore, the press-fit part and the receiving surface can be arranged to face each other on one side face of the fixing part and the other side face.

In addition, the center position of the press-fit part and the center position of the receiving surface are arranged so as to coincide with each other in the width direction of the fixing part. Thus, the insertion force of the press-fit part into the through-hole of the substrate can be received by the receiving surface abutting on the jig, linearly. Further, the insertion force of the press-fit part can be received sufficiently despite only one receiving surface is provided.

Therefore, the press-fit terminal according to the embodiment is capable of receiving the insertion force of the press-fit part by the single receiving surface, thereby allowing the fixing part provided with the receiving surface to be miniaturized.

With the aspect of the present application, it is possible to provide a press-fit terminal capable of miniaturizing its fixing part.

DETAILED DESCRIPTION

Figure 1:
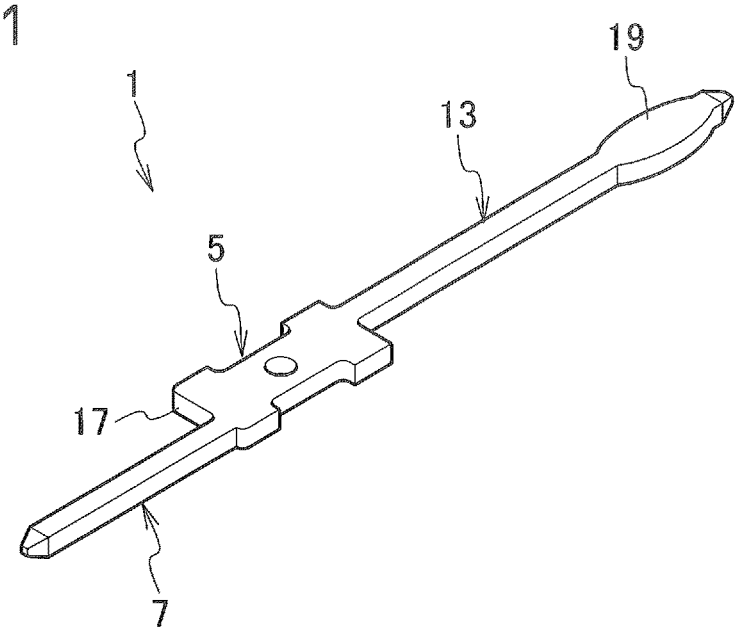
FIG. 1 is a perspective view of a press-fit terminal according to an embodiment.
Figure 2:
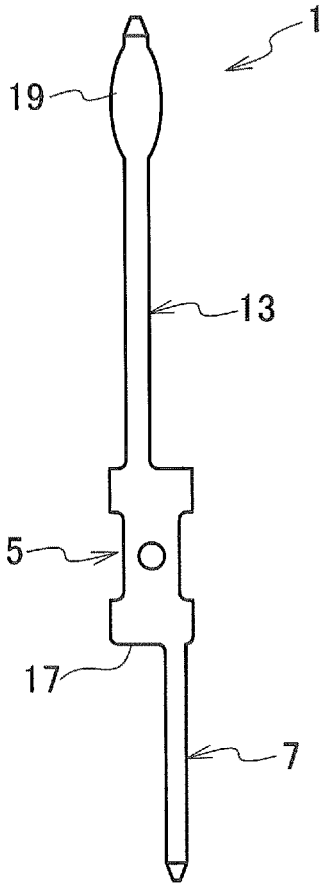
FIG. 2 is a front view of the press-fit terminal according to the embodiment.

A press-fit terminal 1 according to an embodiment will be described with reference to FIGS. 1 to 6.

The press-fit terminal 1 according to the embodiment includes a fixing part 5 to be fixed to a fixing member 3, a terminal part 7 formed by a single member extending from one side face of the fixing part 5 continuously, a press-fit part 13 which is formed by the single member extending from the other side face opposite to the one side face of the fixing part 5 continuously and which is to be closely inserted into a through-hole 11 of a substrate 9, and a receiving surface 17 which is provided on the one side face of the fixing member 5 to make an abutment on a jig 15.

A center position of the terminal part 7 and a center position of the press-fit part 13 are arranged alternately with respect to a center position of the fixing part 5. Also, in a width direction of the fixing part 5, the center position of the press-fit part 13 and a center position of the receiving surface 17 are arranged so as to coincide with each other.

The press-fit terminal 1 is made of conductive material. The press-fit terminal 1 includes the fixing part 5, the terminal part 7, the press-fit part 13, and the receiving surface 17.

Figure 3:
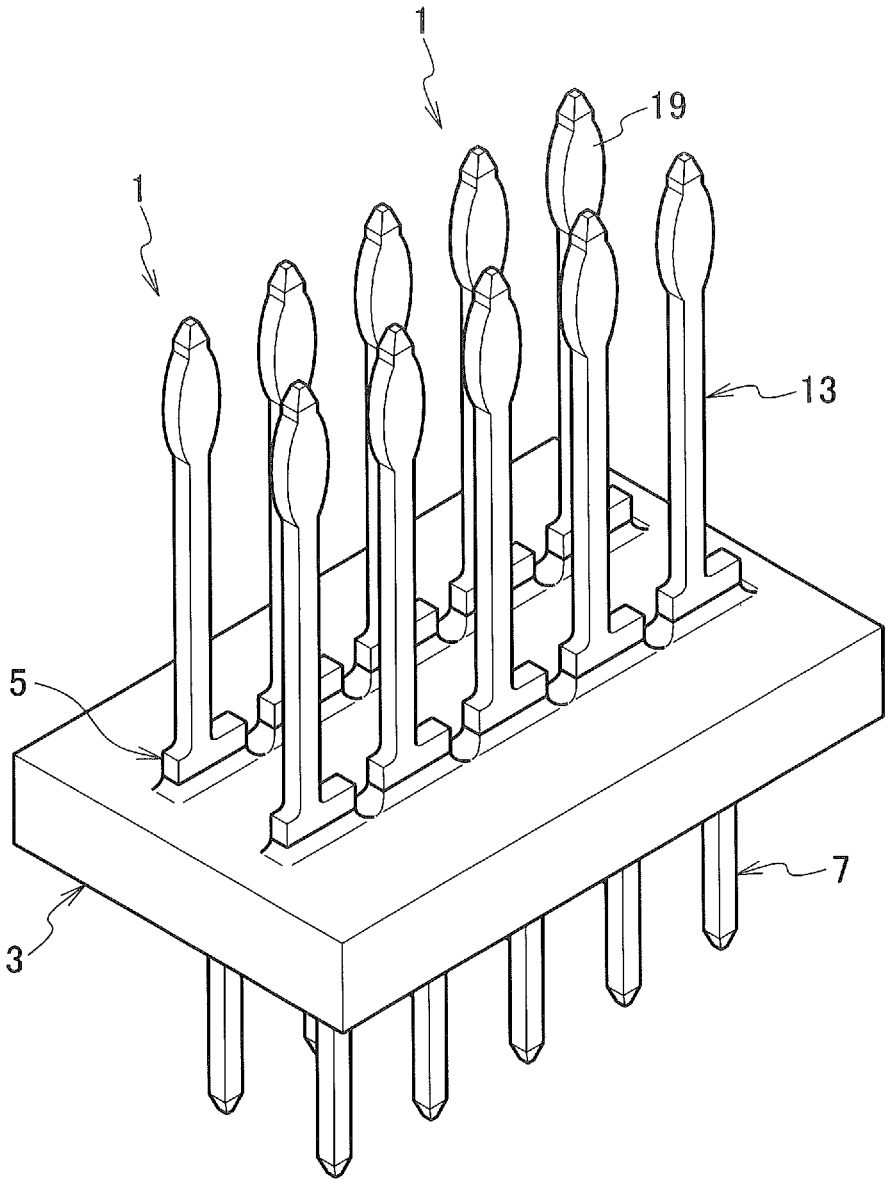
FIG. 3 is a perspective view of an arrangement where a plurality of press-fit terminals according to the embodiment are arranged in a fixing member.

The fixing part 5 is formed into a rectangular shape. As illustrated in FIG. 3, the fixing part 5 is insert-molded in the fixing member 3 made of synthetic resin constituting a connector housing and the like.

As illustrated in FIG. 3, respective fixing parts 5 of a plurality of press-fit terminals 1 are fixed to the fixing member 3 at predetermined positions by insert molding. In the fixing member 3, the press-fit terminals 1 are arranged in multiple rows (five rows in the embodiment) in the width direction of the fixing part 5, and in multiple lines (two lines in the embodiment) in a plate thickness direction of the fixing part 5.

On the fixing part 5 fixed to the fixing member 3, the terminal part 7 is arranged on one side face of the fixing part 5 in the longitudinal direction.

The terminal part 7, which is the single member following the fixing part 5, is formed so as to extend from the one side face of the fixing part 5 in the longitudinal direction, outwardly.

The terminal part 7 is formed so as to protrude from a lower surface (i.e., the one side face) of the fixing member 3 downwardly. For instance, the terminal part 7 is arranged in a fitting part of a connector housing for engaging with a mating connector and also electrically connected to a mating terminal accommodated in the mating connector.

The press-fit part 13 is provided on the other side face of the fixing part 5 in the longitudinal direction, the other side face opposed to the one side face on which the terminal part 7 is provided.

The press-fit part 13, which is the single member following the fixing part 5, is formed so as to extend from the other side face of the fixing part 5 in the longitudinal direction, outwardly. The press-fit part 13 is provided, on a tip side thereof, with a press-fitting portion 19 which is closely inserted (i.e. press-fitted) into the through-hole 11 formed in a conductive part of the substrate 9.

Figure 5:
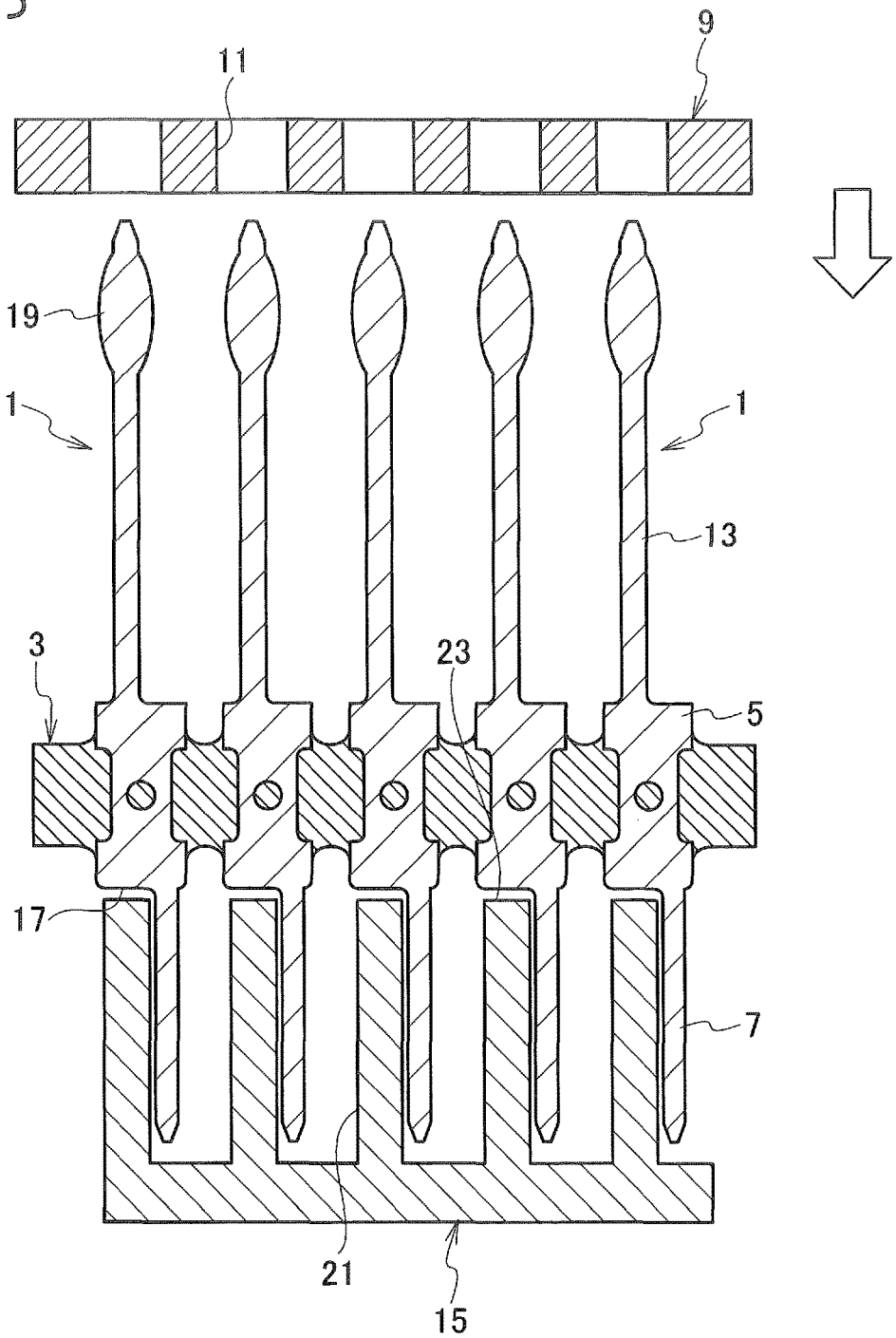
FIG. 5 is a cross sectional view illustrating a situation when the press-fit terminals according to the embodiment are inserted into through-holes of a substrate.
Figure 6:
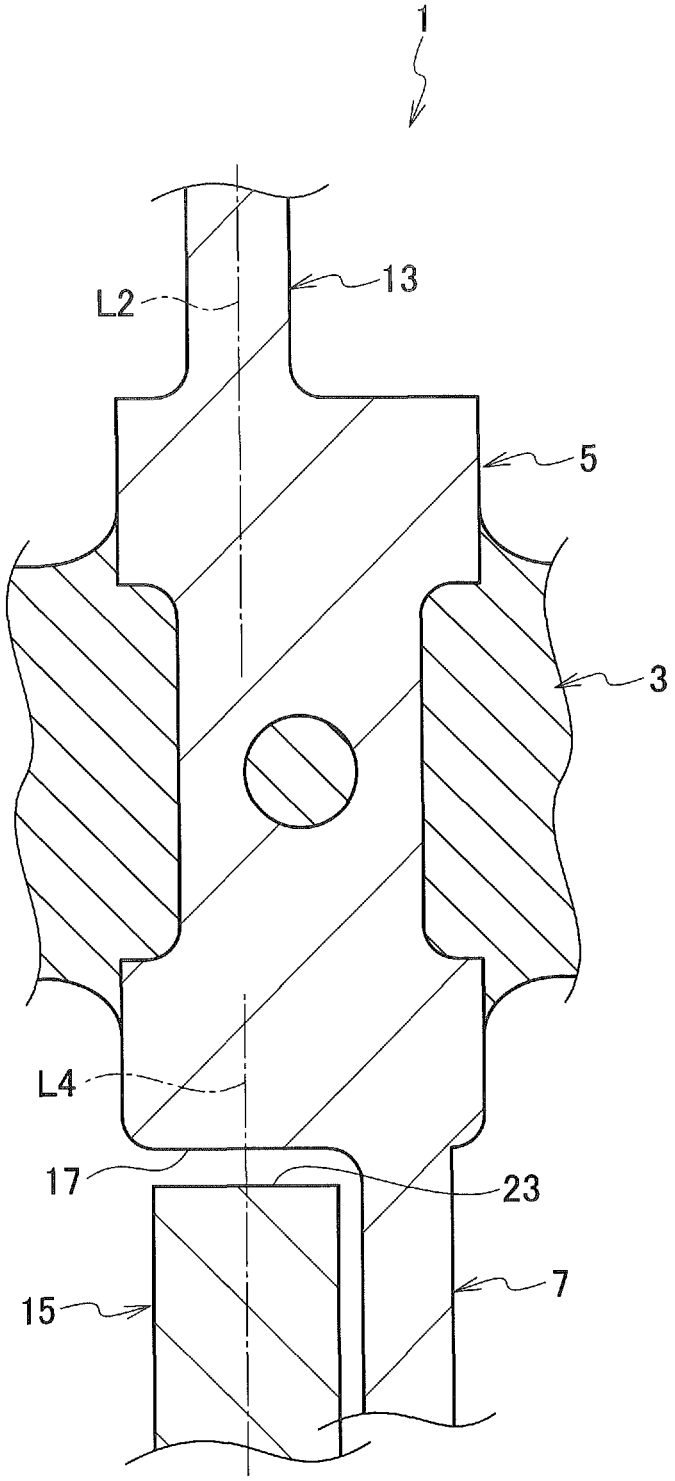
FIG. 6 is an enlarged view of an essential part of FIG. 5.

With the arrangement of disposing the jig 15 on the side of the terminal part 7 of each press-fit terminal 1, as illustrated with an arrow of FIG. 5, by applying a load to the substrate 9 from the side of the press-fit part 13, the press-fitting portion 19 is pressed into the through-hole 11 of the substrate 9. Thus, the press-fit terminals 1 and the board 9 are electrically connected with each other.

The jig 15 is adapted so as to receive a load when press-fitting the press-fit part 13 into the through-hole 11. The jig 15 is provided with a plurality of insertion parts 21 which allow an insertion of the terminal parts 7 of the multiple press-fit terminals 1 and a plurality of abutting parts 23 which are provided on inlet sides of the insertion parts 21 to abut on the receiving surfaces 17 of the fixing parts 5.

When the press-fit part 13 is press-fitted into the through-hole 11, the abutting part 23 of the jig 15 abuts on the receiving surface 17 of the fixing part 5 to support the fixing part 5 so as not to produce any movement of the fixing member 5 in relation to the fixing member 3.

The receiving surface 17, which constitutes one side face of the fixing part 5 in the longitudinal direction, is also arranged on one end side of the terminal part 7. The receiving surface 17 abuts on the abutting part 23 of the jig 15, thereby allowing the fixing member 3 to hold the fixing part 5.

In the conventional press-fit terminal, the receiving surfaces for abutment on the abutting part of the jig are arranged on both sides of the terminal part. That is, the conventional press-fit terminal includes one terminal part and two receiving surfaces interposing the terminal part and additionally, the center position of the terminal part between the two receiving surfaces coincides with the center position of the press-fit part in the width direction of the fixing part.

Thus, the load at the time of press-fitting the press-fit part into the through-hole cannot be applied to the two receiving surfaces linearly, but divided into the two receiving surfaces about the center of the terminal part. For this reason, the contact areas of the two receiving surfaces with the abutting part of the jig had to be secured greatly in view of receiving the load sufficiently.

However, if increasing the contact areas of the two receiving surfaces, the fixing part is enlarged in the width direction. As a result, for example, in the arrangement where a plurality of press-fit terminals is disposed in the fixing member, the distance between the adjoining press-fit terminals would be increased undesirably. For this reason, many press-fit terminals couldn't be retained in the fixing member.

On the contrary, in the press-fit terminal 1 according to the embodiment, the center position of the terminal part 7 and the center position of the press-fit part 13 are disposed alternately with respect to the center position of the fixing part 5 and furthermore, the center position of the press-fit part 13 and the center position of the receiving surface 17 are disposed so as to coincide with each other in the width direction of the fixing part 5.

Figure 4:
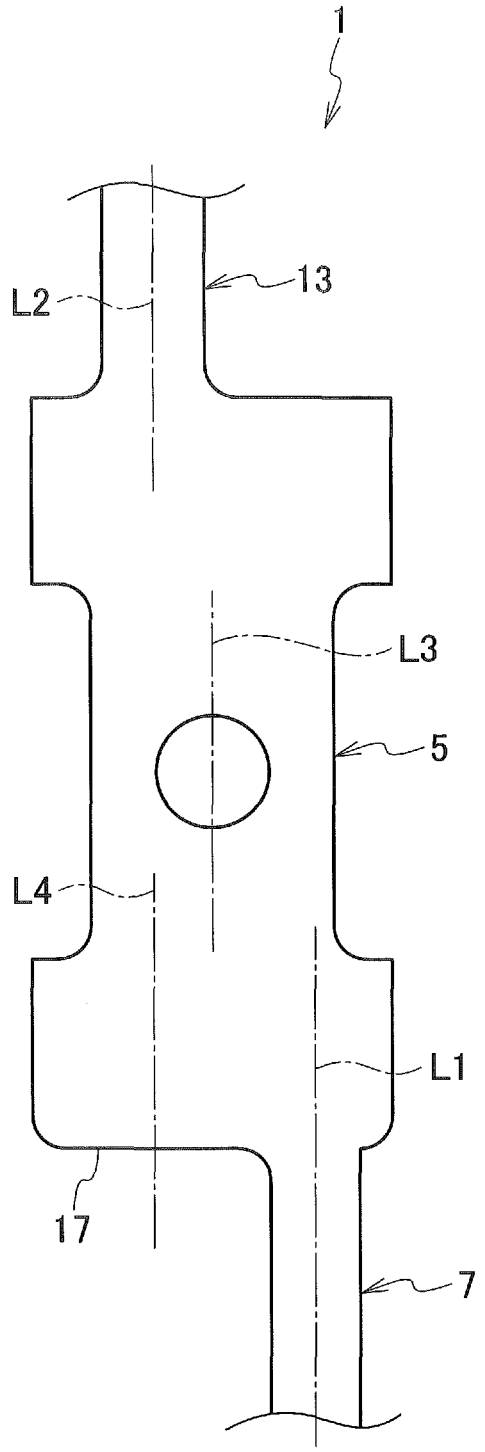
FIG. 4 is an enlarged front view of an essential part of the press-fit terminal according to the embodiment.

Namely, as illustrated in FIG. 4, the center line L1 of the terminal part 7 and the center line L2 of the press-fit part 13 are disposed alternately with respect to a center line L3 of the fixing part 5 (i.e. disposed line-symmetrically to the center line L3), so that the center line L1 of the terminal part 7 is arranged on the right side in one side face of the fixing part 5, while the center line L2 of the press-fit part 13 is arranged on the left side on the other side face of the fixing part 5 (in view of FIG. 4).

Since the terminal part 7 and the press-fit part 13 are provided on the fixing part 5 in this way, the receiving surface 17 can be disposed on the left side on the one side surface of the fixing part 5 (in view of FIG. 4), thereby allowing the press-fit part 13 and the receiving surface 17 to be disposed opposite with each other on both sides of the fixing part 5 in the longitudinal direction.

Additionally, the center line L2 of the so-disposed press-fit part 13 and the center line L4 of the receiving surface 17 as the center of an abutment on the abutting part 23 of the jig 15 are arranged on the same straight line.

Consequently, the load at the time of press-fitting the press-fit part 13 into the through-hole 11 can be linearly applied to the single receiving surface 17 without being divided into two forces and additionally, the same load can be received by the receiving surface 17 sufficiently without increasing the contact area of the jig 15 with the receiving surface 17.

Thus, by arranging the center position of the terminal part 7 and the center position of the press-fit part 13 alternately with respect to the center position of the fixing part 5 and also arranging the center position of the press-fit part 13 and the center position of the receiving surface 17 so as to coincide with each other in the width direction of the fixing part 5, it is possible to ensure the contact area of the receiving surface 17 sufficiently and reduce a dimension of the fixing part 5 in the width direction of the press-fit terminal 1, thereby enhancing its miniaturization.

For this reason, it is possible to narrow the distance between the adjacent press-fit terminals 1, 1 of the plurality of press-fit terminals 1 disposed on the fixing member 3, thereby allowing many press-fit terminals 1 to be disposed. Additionally, it is possible to improve the manufacturing yield of a press-fit terminal.

In the press-fit terminal 1 according to the embodiment, the center position of the terminal part 7 and the center position of the press-fit part 13 are arranged alternately with respect to the center position of the fixed part 5. Therefore, the press-fit part 13 and the receiving surface 17 can be arranged to face each other on one side face and the other side face of the fixing part 5.

Further, the center position of the press-fit part 13 and the center position of the receiving surface 17 are arranged so as to coincide with each other. Therefore, the insertion force of the press-fit part 13 into the through-hole 11 of the substrate 9 can be received by the receiving surface 17 abutting on the jig 15, linearly. Further, the insertion force of the press-fit part 13 can be received sufficiently despite only one receiving surface 17 is provided.

Therefore, The press-fit terminal 1 according to the embodiment is capable of receiving the insertion force of the press-fit part 13 by the single receiving surface 17, thereby allowing the fixing part 5 provided with the receiving surface 17 to be miniaturized.

Although the terminal part 7 is disposed on the right side of the fixing part 5 while disposing the press-fit part 13 on the left side of the fixed part 5 in the press-fit terminal 1 of the embodiment illustrated in FIG. 4, the center position of the terminal part 7 and the center position of the press-fit part 13 have only to be arranged alternately with respect to the center position of the fixed part 5. For instance, the terminal part 7 may be arranged on the left side of the fixed part 5 while disposing the press-fit part 13 on the right side of the fixed part 5.

Additionally, the fixing part 5 is insert-molded in the fixing member 3 in the embodiment, but is not limited to this, any method may be used in fixing the fixing part 5 to the fixing member 3, for example, by press-fitting.

What is claimed is:

1. A press-fit terminal having a plate-like shape, comprising:

a fixing part to be fixed to a fixing member;

a terminal part formed by a single member continuously extending from one side face of the fixing part;

a press-fit part formed by the single member continuously extending from an opposite side face of the fixing part, the press-fit part configured to be inserted into and closely contacted with a through-hole of a substrate; and a receiving surface arranged on the one side face of the fixing part of which the terminal part extends, the receiving surface configured to abut on a jig, wherein a center axis of the terminal part along a longitudinal direction of the press-fit terminal and a center axis of the press-fit part along the longitudinal direction of the press-fit terminal are arranged alternately with respect to a center axis of the fixing part along the longitudinal direction of the press-fit terminal, and the center axis of the press-fit part along the longitudinal direction of the press-fit terminal and a center axis of the receiving surface along the longitudinal direction of the press-fit terminal are aligned with each other in a width direction of the fixing part.

2. The press-fit terminal according to claim 1, wherein the press-fit terminal is made of a conductive material.

3. A connector housing, comprising:

a fixing member;

a substrate having one or more through-holes; and one or more press-fit terminals, each press-fit terminal having a plate-like shape and comprising:

a fixing part to be fixed to the fixing member;

a terminal part formed by a single member;

a press-fit part formed by the single member continuously extending from an opposite side face of the fixing part, the press-fit part configured to be inserted into and closely contacted with a corresponding through-hole of the substrate; and a receiving surface arranged on the one side face of the fixing part of which the terminal part extends, the receiving surface configured to abut on a jig, wherein a center axis of the terminal part along a longitudinal direction of the press-fit terminal and a center axis of the press-fit part along the longitudinal direction of the press-fit terminal are arranged alternately with respect to a center axis of the fixing part along the longitudinal direction of the press-fit terminal, and the center axis of the press-fit part along the longitudinal direction of the press-fit terminal and a center axis of the receiving surface along the longitudinal direction of the press-fit terminal are aligned with each other in a width direction of the fixing part.

4. The connector housing according to claim 3, wherein the connector housing comprises a plurality of the press-fit terminals, and the press-fit terminals are arranged in multiple rows in a width direction of the fixing parts, and in multiple lines in a plate thickness direction of the fixing parts.

5. The connector housing according to claim 3, wherein the fixing part of each of the press-fit terminals is insert-molded in a corresponding through-hole of the fixing member.

6. The connector housing according to claim 5, wherein the fixing member is made of a synthetic resin.

7. The connector housing according to claim 3, wherein the terminal part of each of the press-fit terminals is arranged in a fitting part of the connector housing and is configured to engage with a mating connector and electrically connect to a corresponding mating terminal accommodated in the mating connector.

8. The connector housing according to claim 3, wherein the press-fit part of each of the press-fit terminals is inserted into a corresponding through-hole of the substrate formed in a conductive part of the substrate.

9. The connector housing according to claim 3, wherein the press-fit terminals and the substrate are electrically connected with each other.

10. The connector housing according to claim 3, wherein an abutting part of the jig abuts against the receiving surface of each of the press-fit terminals to support the fixing part of each of the press-fit terminals and to restrict movement of the fixing member.

* * * * *